US009391415B2

(12) United States Patent
Swedberg et al.

(10) Patent No.: US 9,391,415 B2
(45) Date of Patent: Jul. 12, 2016

(54) METHODS AND APPARATUS FOR GROUNDING AN ELECTRICAL DEVICE VIA A LAMPHOLDER

(71) Applicant: IDEAL Industries, Inc., Sycamore, IL (US)

(72) Inventors: Benjamin David Swedberg, Sycamore, IL (US); Joshua Abraham Ott, Dekalb, IL (US)

(73) Assignee: IDEAL Industries, Inc., Sycamore, IL (US)

( * ) Notice: Subject to any disclaimer, the term of this patent is extended or adjusted under 35 U.S.C. 154(b) by 0 days.

(21) Appl. No.: 14/590,615

(22) Filed: Jan. 6, 2015

(65) Prior Publication Data

US 2015/0118879 A1 Apr. 30, 2015

Related U.S. Application Data

(62) Division of application No. 13/595,450, filed on Aug. 27, 2012, now Pat. No. 8,956,019.

(51) Int. Cl.

| | |
|---|---|
| ***H01R 33/02*** | (2006.01) |
| ***H01R 33/08*** | (2006.01) |
| ***F21K 99/00*** | (2016.01) |
| *H01R 103/00* | (2006.01) |
| *H01R 24/78* | (2011.01) |

(52) U.S. Cl.

CPC ..... *H01R 33/0827* (2013.01); *F21K 9/175* (2013.01); *H01R 24/78* (2013.01); *H01R 2103/00* (2013.01)

(58) Field of Classification Search

CPC ..... H01R 33/0836
USPC ..... 439/239–241, 226, 56
See application file for complete search history.

(56) References Cited

U.S. PATENT DOCUMENTS

| | | | | | |
|---|---|---|---|---|---|
| 1,835,688 | A | * | 12/1931 | Atwood | H01R 13/20 439/642 |
| 2,137,174 | A | * | 11/1938 | Marshaus | H01R 33/08 362/217.17 |
| 2,247,117 | A | | 3/1939 | DeReamer | |
| 3,706,956 | A | * | 12/1972 | Epifani | H02G 3/20 439/376 |
| 3,781,755 | A | * | 12/1973 | Pitacco | B60Q 3/044 439/101 |
| 3,798,584 | A | * | 3/1974 | Person | H02G 3/20 174/62 |
| 3,805,211 | A | * | 4/1974 | Moore | H01R 13/20 439/101 |
| 4,040,709 | A | * | 8/1977 | Dola | B60Q 1/2607 439/211 |
| 4,565,415 | A | * | 1/1986 | Feinberg | H01R 33/0854 439/232 |

(Continued)

FOREIGN PATENT DOCUMENTS

EP 1780818 A2 5/2007

OTHER PUBLICATIONS

ISA/US, International Search Report and Written Opinion issued on PCT Application No. US2013/54656, received Feb. 3, 2014, 11 pages.

*Primary Examiner* — Neil Abrams
(74) *Attorney, Agent, or Firm* — Greenberg Traurig, LLP

(57) ABSTRACT

A lampholder includes a housing and a plurality of electrical terminals. The lampholder is adapted to hold a light-emitting diode (LED) tube light assembly supported at two ends of the tube light. The lampholder includes at least one terminal that electrically couples before the remaining terminals located in the same housing to ensure a first-connect, last-disconnect electrical connection when inserting the LED tube light into and removing the LED tube light from the lampholder.

5 Claims, 12 Drawing Sheets

(56) References Cited

U.S. PATENT DOCUMENTS 4,947,082 A * 8/1990 French ..... H01R 33/09 313/318.01
5,007,848 A * 4/1991 Lee ..... H01R 27/02 439/101
5,078,625 A * 1/1992 Anzai ..... F21S 48/212 439/356
5,356,297 A * 10/1994 Haskins ..... H01R 33/09 439/398
5,536,174 A * 7/1996 Forish ..... B60Q 1/2607 439/57
5,616,042 A * 4/1997 Raby, Sr. ..... F21V 23/06 439/226
5,688,042 A 11/1997 Madadi et al.
5,695,367 A * 12/1997 Takano ..... H01R 13/743 439/699.2
5,816,837 A 10/1998 Henrici et al.
5,971,811 A * 10/1999 Mori ..... H01R 4/489 439/675
6,139,334 A * 10/2000 Forish ..... B60Q 1/2607 362/487
6,364,679 B1 4/2002 Gerstberger
7,097,327 B1 8/2006 Barton
7,549,787 B1 6/2009 Blaymore
7,591,695 B2 * 9/2009 Handa ..... H01R 33/02 439/637
7,604,386 B2 * 10/2009 Rawlings ..... F21S 48/1109 362/548
7,604,494 B2 * 10/2009 Cho ..... H01R 33/0827 439/232
7,607,805 B2 * 10/2009 Kwon ..... F21V 19/008 362/217.14
7,926,965 B2 * 4/2011 Cho ..... G02F 1/133604 362/613
8,128,420 B2 * 3/2012 Kamata ..... G02F 1/133604 439/95
8,251,710 B2 * 8/2012 Chen ..... H01R 12/7076 439/232
8,282,408 B1 10/2012 Chou et al.
8,956,019 B2 * 2/2015 Swedberg ..... F21K 9/175 362/382
9,209,546 B1 * 12/2015 Gibboney, Jr. ..... H01R 13/17
2010/0033095 A1 2/2010 Sadwick
2011/0051414 A1 3/2011 Bailey et al.
2011/0223785 A1 9/2011 Jiang et al.
2011/0317408 A1 * 12/2011 Chen ..... F21V 19/0085 362/217.14
2012/0307524 A1 12/2012 Schapira et al.
2013/0119896 A1 5/2013 Fukano et al.
2013/0329414 A1 12/2013 Kusunose
2015/0118879 A1 * 4/2015 Swedberg ..... F21K 9/175 439/226
2015/0222054 A1 * 8/2015 Kato ..... H01R 13/71 439/372

* cited by examiner

METHODS AND APPARATUS FOR GROUNDING AN ELECTRICAL DEVICE VIA A LAMPHOLDER

RELATED APPLICATION INFORMATION

This application is a divisional of and claims the benefit of U.S. application Ser. No. 13/595,450, filed on Aug. 27, 2012, the disclosure of which is incorporated herein by reference in its entirety.

FIELD OF THE DISCLOSURE

The present description relates generally to lampholders for electrical devices, such as for example for tube lamps, and more particularly, to methods and apparatus for grounding an electrical device via a lampholder.

BACKGROUND OF RELATED ART

Traditional fluorescent tube lamps, such as for example T-5 and T-8 lamps, use fluorescent technology and only require two pins, e.g., electrical contacts, at the two ends of the tube lamp and in corresponding contacts in the lampholders. These lampholders, typically referred to as tombstone style lampholders are generally well known in the art.

For example, U.S. Pat. No. 2,247,117 describes a lampholder or socket for a lamp having a double end discharge, such as a fluorescent tube design. The described socket includes a base, a cover, and two contact members. The contact members cooperate with and engage the contact pins extending from a base at each end of the tubular lamp, such as a fluorescent lamp. The base and housing of the socket are typically made of any suitable insulating material. In use, the contacts of the tubular lamp are mounted to the socket by inserting the contacts of the lamp into a slot provided in the socket. Thereafter, the lamp is rotated ninety degrees to engage the contacts of the lamp with the contacts of the lampholder.

Recently, new light-emitting diode (LED) tubes have been designed to fit into the same lampholders as previously used in fluorescent tube lamps. An LED tube is made up of dozens of individual LEDs. They come in a variety of sizes (e.g., 2, 4 or 6 feet), different color temperatures (i.e., different colors of light), and varying lumen output. LED tubes can be purchased with new fixtures, or used for retrofitting existing fixtures. However, LED tubes don't require the ballasts that traditional fluorescents need, so the ballasts need to be removed when replacing fluorescent bulbs with LED tubes. Instead of a ballast, LEDs use a driver to convert the line AC voltage to DC and to provide other conditioning and control. Often the driver is contained in the same housing as the LEDs, meaning a line voltage shock risk is present Other times, even with the driver housed separately, the input DC voltage to the lamp can still be high enough to be a shock risk (NEC Circuit Class 1). As such, LED lamps can sometimes pose a safety risk due to exposed metal for reasons such as, for instance, heat-sinking or electrical contacts.

Recently some LED systems have been developed with switches in the LED tubes for safety purposes. These safety switches, while sufficient for their intended purposes, add cost and complexity to the lamp that may not be desirable in some manufacturing instances.

Still further, in other LED tube systems, such as the Japanese JELMA 801 standard, an incorporated ground path is provided for performance reasons. For instance, a GX16t-5 LED lamp includes a power input side, having two connectors, and a ground side at the opposite end. In operation, the user can insert the power side into the respective lampholder before inserting the ground side. Oftentimes, insertion of the power side first is without risk to the installer, but that may not always be the case, such as for instance, when the power level is not NEC Circuit Class 2.

Thus, there is a recognizable need for safe and convenient methods and apparatus for grounding an LED tube as disclosed herein.

DETAILED DESCRIPTION

The following description of example methods and apparatus is not intended to limit the scope of the description to the precise form or forms detailed herein. Instead the following description is intended to be illustrative so that others may follow its teachings.

In general, in one example, the present disclosure provides for a three terminal lampholder that assures the ground (earth) terminal of the lamp, such as, for example an LED lamp, makes first contact and break last relative to the power terminals. More particularly, as described herein, the example lamp includes a three terminal design, having two contact terminals and a ground terminal. In operation, as the lamp is inserted into the lampholder, the ground terminal of the lamp makes contact with a ground terminal of the example lampholder. In this instance, once the lamp is fully inserted, the ground terminal is fully engaged, and the power terminals are not yet energized as they do not contact the power terminals of the lampholder. The lamp may then be rotated to electrically couple the power contacts of the lamp and lampholder. The example lampholder may be self-grounding as the ground terminal may be in contact with the luminaire metal to provide a ground path without external wiring between the lampholder and the luminaire.

In another example, the present disclose may provide for the use a self-grounding terminal in a single terminal lampholder such as the ground end of a GX16t-5 as previously discussed. As with the ground terminal of the example three-terminal design disclosed herein, the single terminal lampholder may be provided with an exposed portion to self-ground the terminal to the luminaire.

Figure 1:
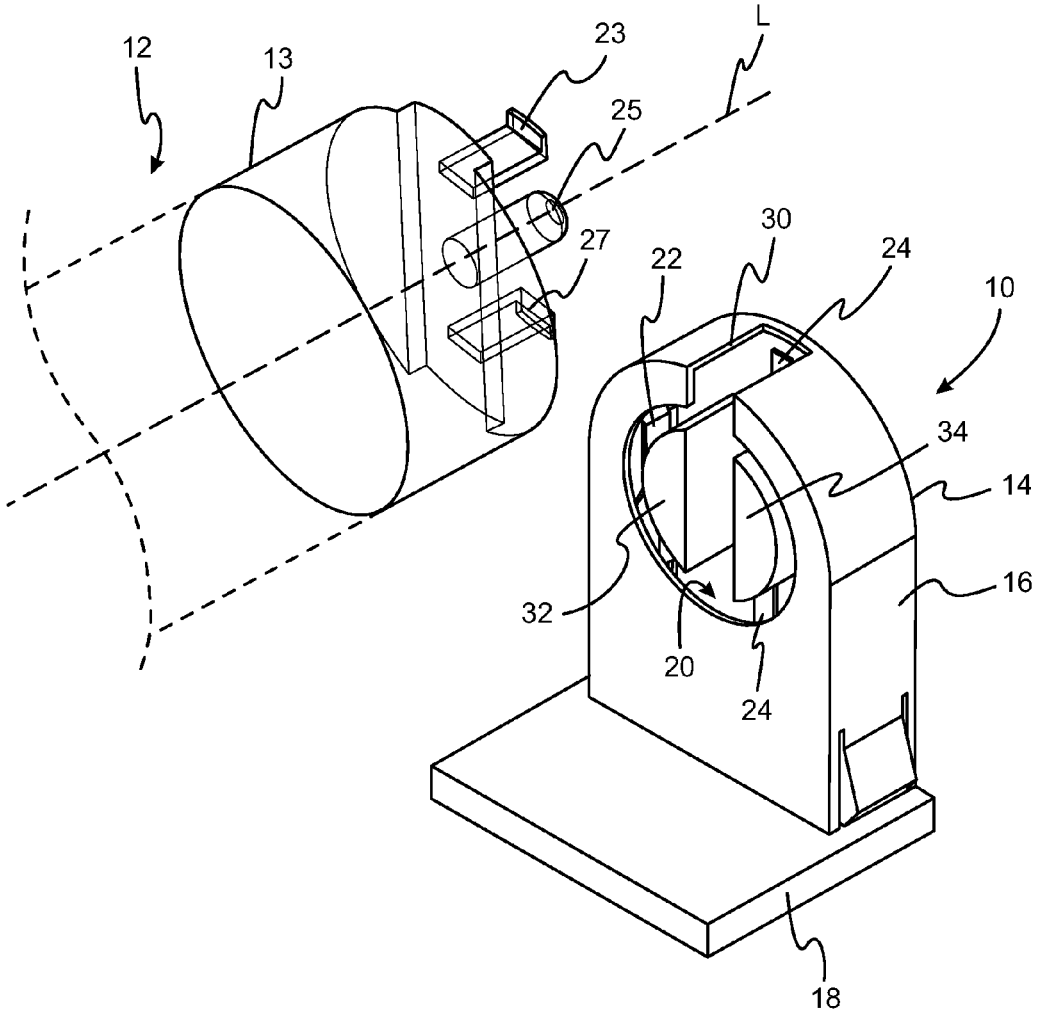
FIG. 1 is a front perspective view of an example lampholder and tube lamp assembly in accordance with an example of the present disclosure.
Figure 2:
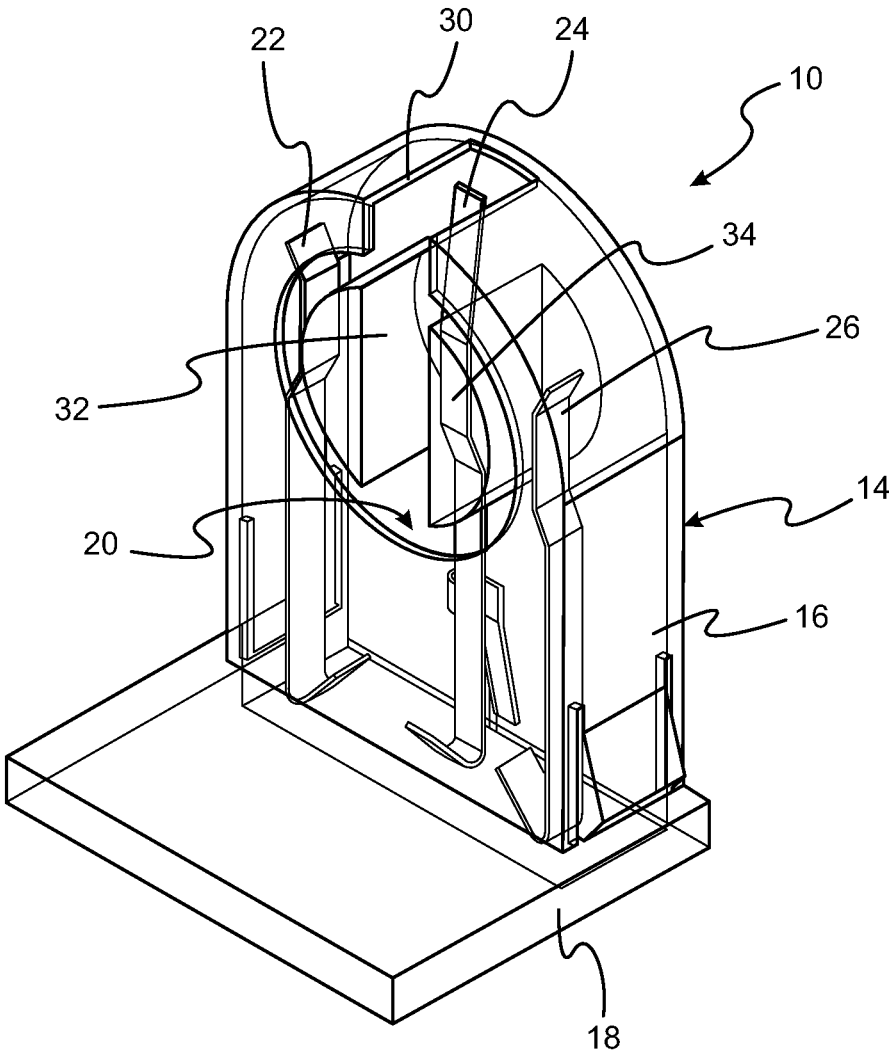
FIG. 2 is a front perspective view of the example lampholder showing the interior of the lampholder housing.
Figure 3:
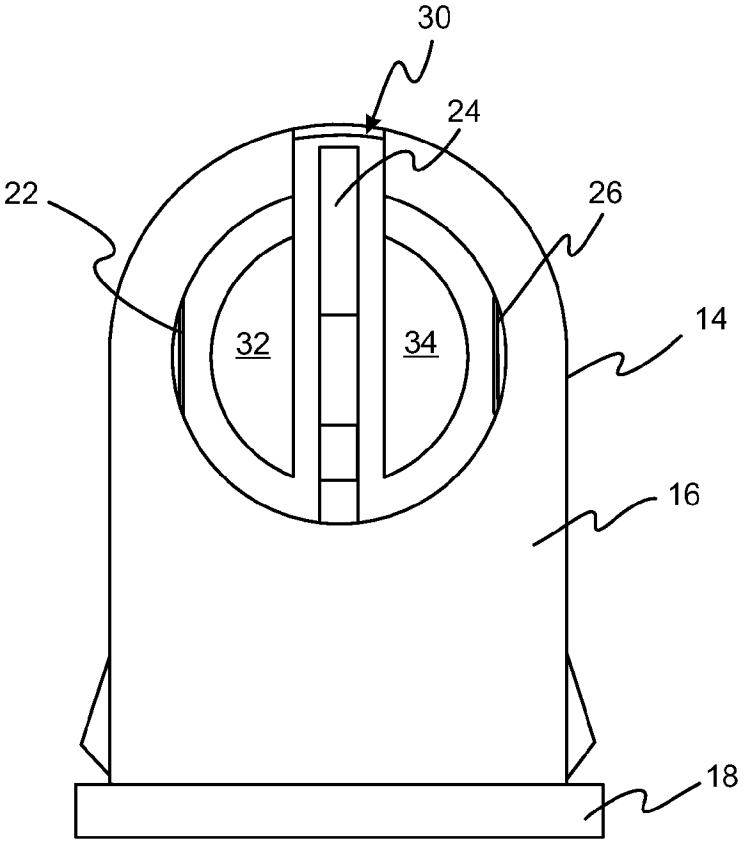
FIG. 3 is a front elevational view of the example lampholder.
Figure 4:
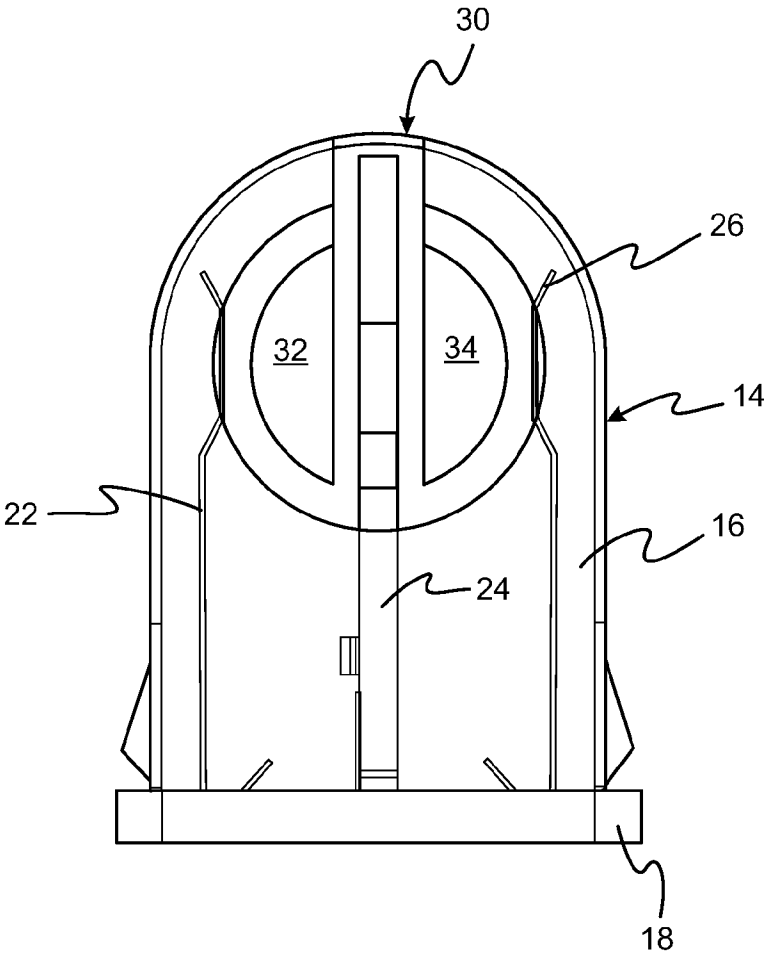
FIG. 4 is a front elevational view of the example lampholder showing the interior of the lampholder housing.

Referring now to FIGS. 1 and 2, an example lampholder 10 for grounding an example tube-type lamp 12 is illustrated. In this example, the lamp 12 is an LED tube-type lamp, although the lamp 12 may be any suitable type of lamp as desired. The example lampholder 10 includes a lampholder housing 14, which in this example comprises an upright housing portion 16 and a base portion 18. The upright housing portion 16 is adapted to releasably retain the contact terminals of the lamp 12 as will be discussed. The example base portion 18, meanwhile, is adapted for connection to a luminaire plate of other suitable surface. The housing 14 defines an interior space 20, in which the example lampholder 10 houses three contacts 22, 24, and 26, electrically isolated from one another. In this example, two of the contacts 22, 26 are arranged to electrically couple to a corresponding power terminal 23, 27, respectively, provided on an end cap 13 of the lamp 12. Similarly, the third contact 24 is arranged to electrically couple to a corresponding ground terminal 25, also provided on the end cap 13 of the lamp 12.

In this example, the two power terminals are radially offset from a longitudinal axis L of the lamp 12, while the ground terminal 25 is generally coaxially aligned with the axis L. Thus, as will be appreciated, rotation of the lamp 12 about the axis L will changed the position of the power terminals 23, 27, while maintaining the general position of the ground terminal 25.

As shown in FIGS. 1-4, an insertion slot 30 for receiving the three terminals 23, 25, 27 is defined by the housing 14. The insertion slot 30 extends inward towards the base portion 18 and is sized to receive the terminals 23, 25, 27 therein. The insert slot includes a pair of arcuate flanges 32, 34 extending from the housing 14 and arranged inside the interior space 20. The flanges 32, 34 are shaped such that the fully inserted lamp 12 may rotate in the lampholder 14 such that the terminals 23, 25, 27 can be pivoted outside of the outer surface of the flanges 32, 34 to electrically couple to the contacts 22, 24, 26. As will be appreciated by one of ordinary skill in the art, the outer surface of the flanges 32, 34 may include at least one notch, cut-out, and/or other detent proximate the contacts 22, 26 to provide a retention location and/or visual or physical feedback to the installer that the lamp 12 is properly rotated and retained in the lampholder 14.

Still further, it will be understood by one of ordinary skill in the art that the housing 14 may comprise, for example, multiple parts molded and/or otherwise formed and assembled to form the housing. In this manner, the contacts 22, 24, and 26 may be provided in the interior space 20. Additionally, the interior space 20 may include at least one support structure (not shown) for supporting and/or otherwise maintaining the contacts 22, 24, and 26 within the interior space 20 and in electrical contact with an installed lamp 12 as is well known in the art.

Figure 5:
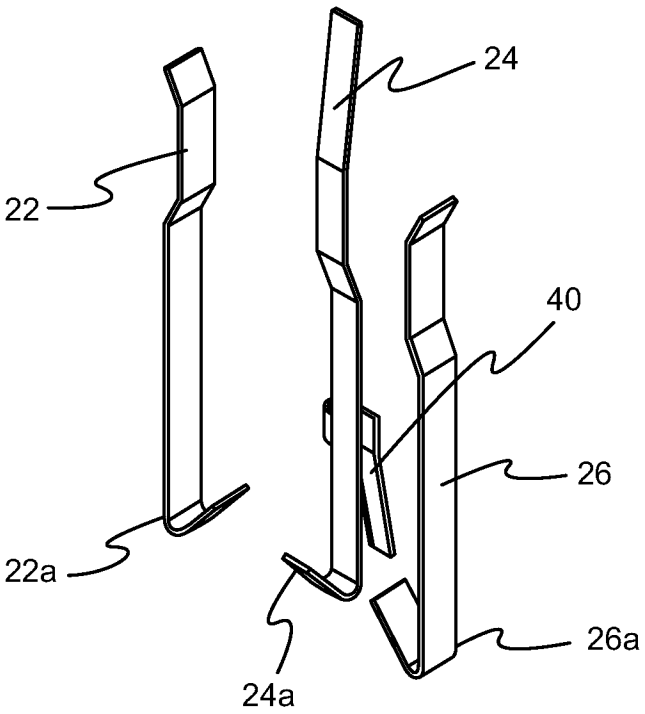
FIG. 5 is a front perspective view of the example terminals disposed within the example lampholder housing.

Turning to FIG. 5, an illustration of the example contacts 22, 24, and 26 is shown without the remaining parts of the lampholder 14. As can be seen, in this example, the contacts 22, 24, and 26 each include a push-in type electrical connector at a first end 22*a*, 24*a*, and 26*a*, respectively. The push-in type connector allows for the insertion of an electrical wire, post, and/or other suitable connector (as desired) through apertures defined in the base portion 18. similarly, each of the contacts 22, 24, 26 are constructed of any suitable electrical conductor, such as a resilient, conductive metal. The flexible material allows the contacts 22, 24, 26 to flex and/or move towards a bias to maintain the electrical connection as necessary.

Figure 6A:
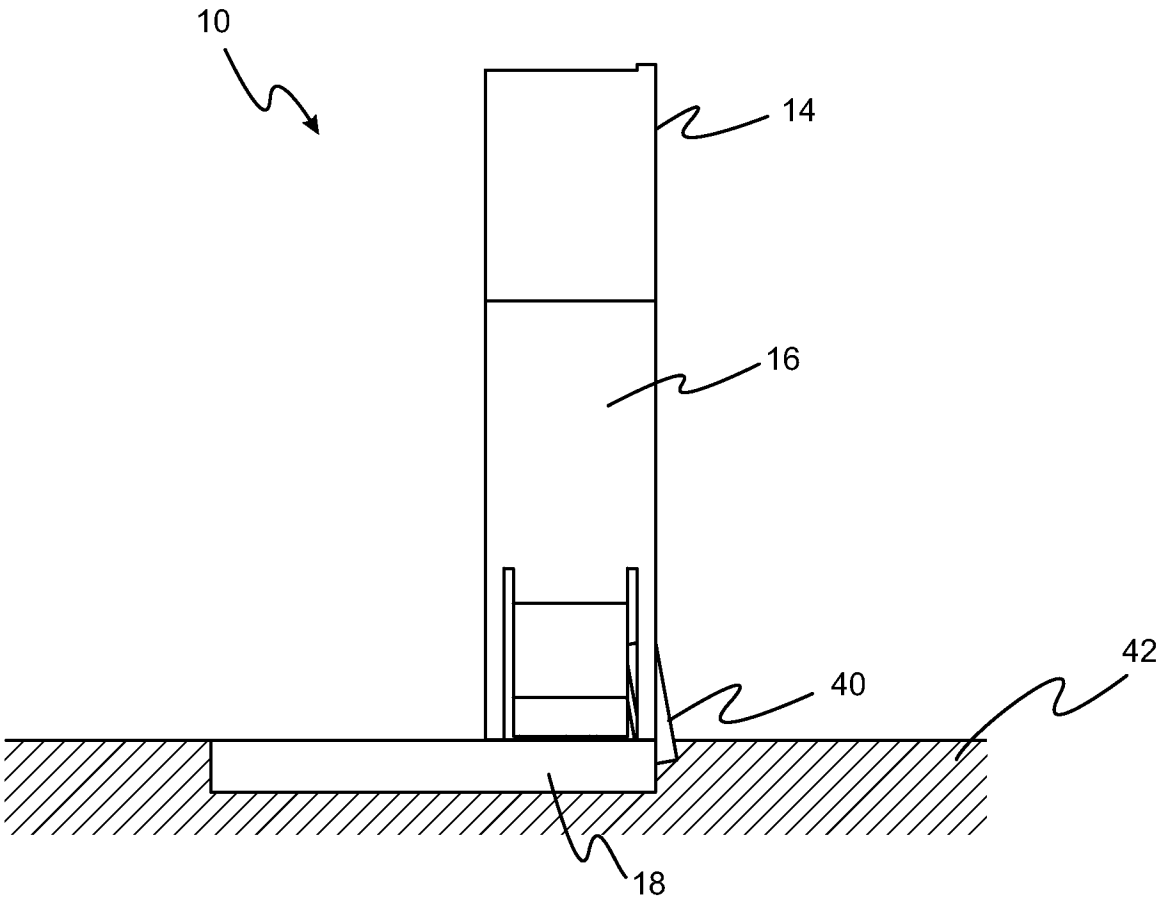
FIG. 6A is a right side elevational view of the example lampholder.
Figure 6B:
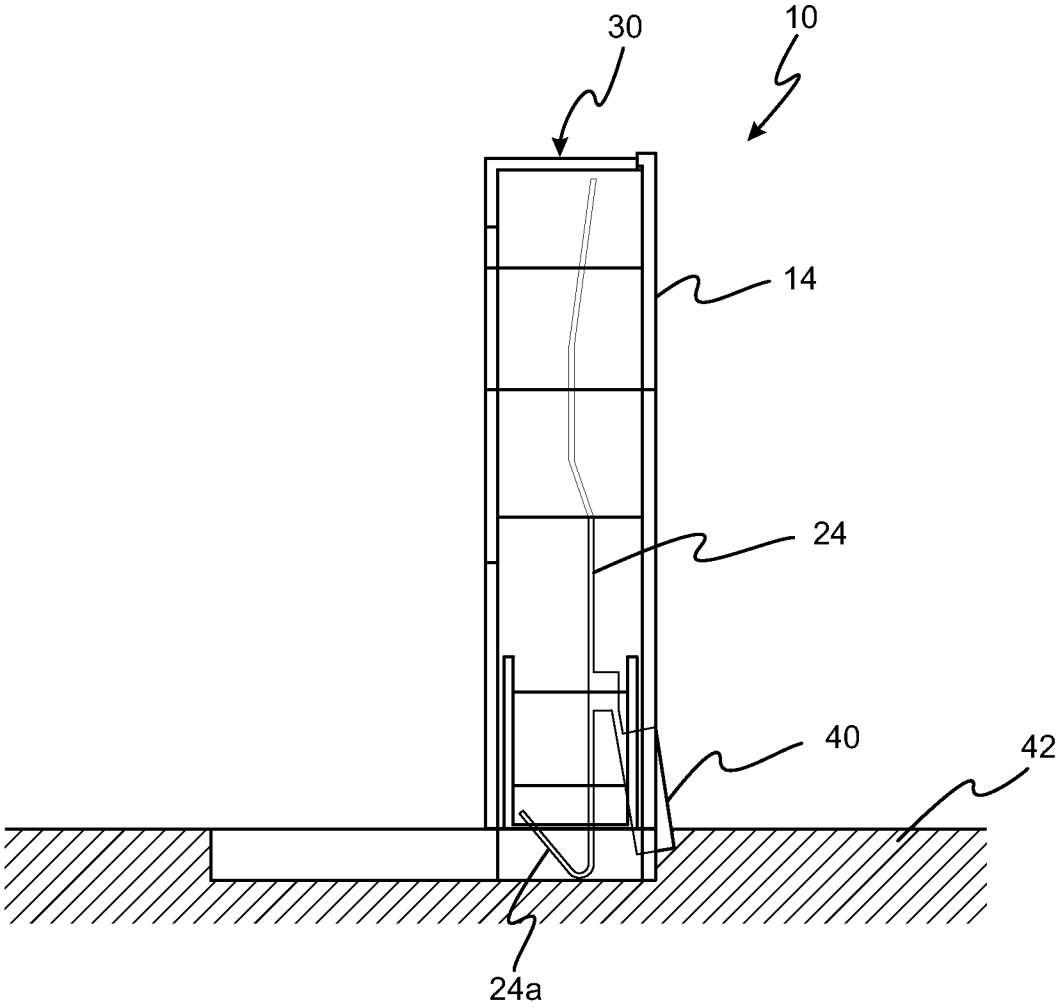
FIG. 6B is a right side elevational view of the example lampholder showing the interior of the lampholder housing.
Figure 7:
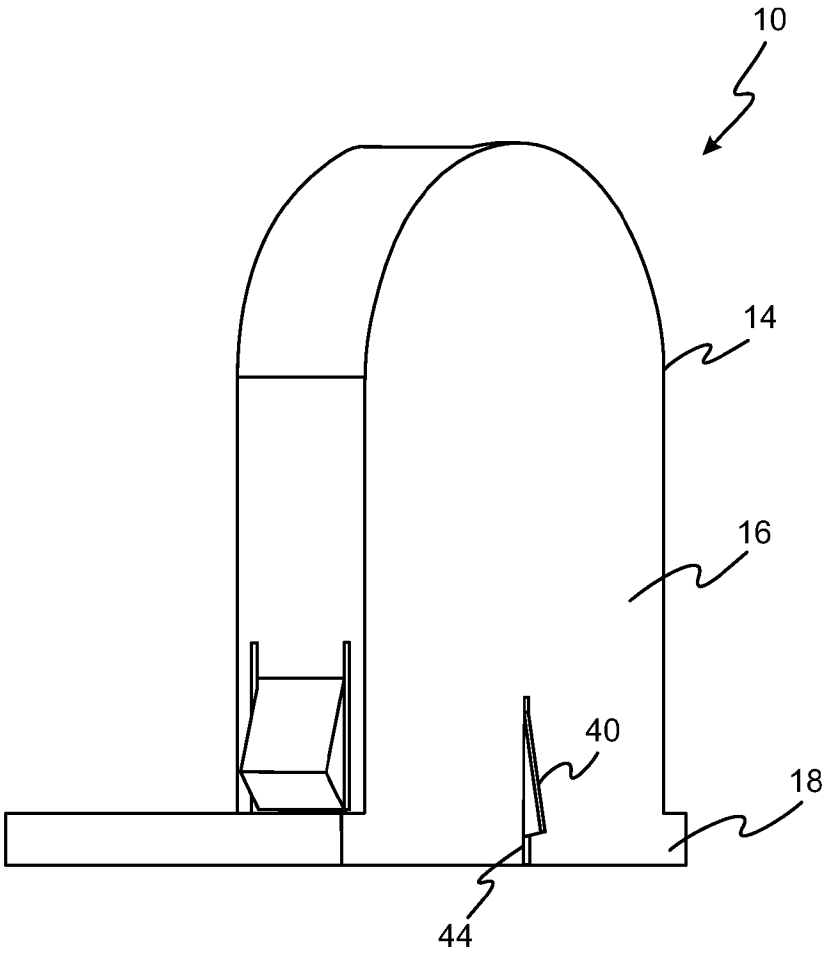
FIG. 7 is a rear perspective view of the example lampholder.
Figure 8:
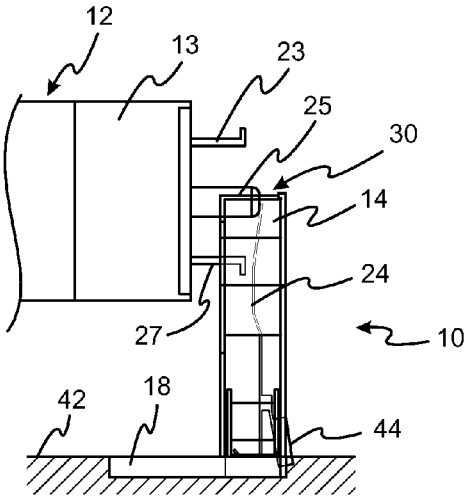
FIG. 8 is a right side elevational view of the example lampholder showing insertion of the tube lamp into the lampholder.

While the ground contact 24 can include an inserted ground wire attached to the push-in type connector 24*a*, as illustrated in FIGS. 5-7, the ground contact 24 may also and/or alternatively include a self-grounding extension 40. As noted, most luminaire use a base 42 (FIG. 6A, 6B) such as a metal structure as a ground path. The example self-grounding extension 40 of the example lampholder 10 allows the ground contact 24 to be in contact with the base 42 to provide a ground path without requiring additional wiring to the lampholder 10. More particularly, the example extension 40 is constructed to be exposed outside of the housing 14 through a slot 44 (FIG. 7) such that the contact 24 is exposed to contact and connect with the metal base 42 of the luminaire. In the presently illustrated example, the extension 40 includes a relatively sharp and/or hard edge that can cut through any surface treatment (e.g., paint) to contact the metal base 42 when properly installed.

Figure 9:
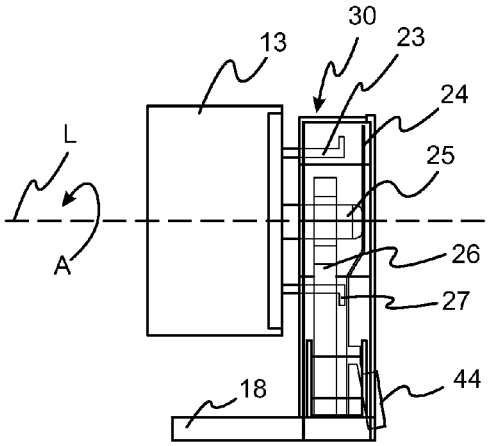
FIG. 9 is a right side elevational view of the assembly of FIG. 8 showing the tube lamp fully inserted into the lampholder.
Figure 10A:
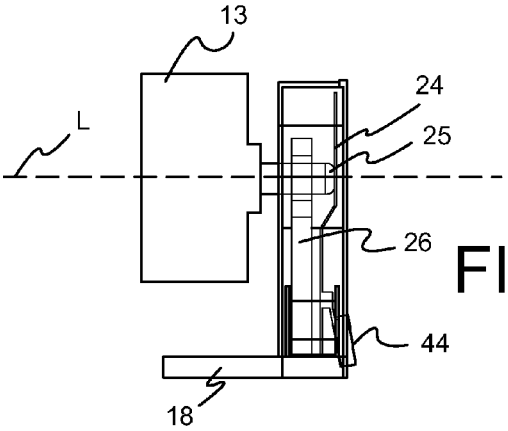
FIG. 10A is a right side elevational view of the assembly of FIG. 9 showing the tube lamp rotated into an installed position.
Figure 10B:
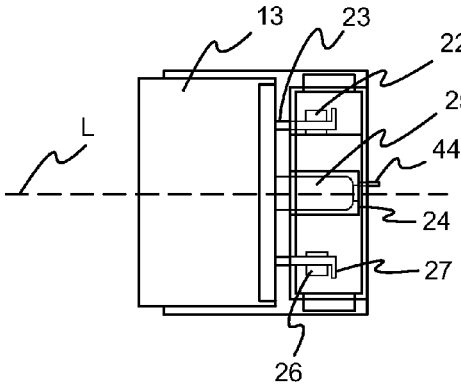
FIG. 10B is a top plan view of the assembly of FIG. 10A.

Referring now to FIGS. 8-10B, to insert the example lamp 12 into the example lampholder 10, the lamp 12 is inserted with its power terminals 23, 27 and its ground terminal 25 into the insertion slot 30 (FIG. 8) until both power terminals 23, 27 and the ground terminal 25 are fully inserted into the lampholder 10 (FIG. 9). In this configuration, it can be seen that the ground terminal 25 of the lamp 12 makes contact with the ground contact 24. In other words, the ground contact is the first contact. It will be appreciated, however, that while the present lamp 12 is inserted radially into the housing, the lamp 12 may be inserted axially into the housing 14 as desired.

By rotating the lamp 12 about the longitudinal axis L in any direction, such as for example, in the direction of the arrow A (FIG. 9), the power terminals 23, 27 override the resilient bias of the contacts 22, 26, allowing the power terminals 23, 27 to rotate about and be guided by the flanges 32, 34. Once fully rotated (FIGS. 10A and 10B), the power terminals 23, 27 push the resilient terminals 24, 26 to the side against their bias and as a result the power terminals 23, 27 are retained and an electrical contact is produced. The lamp 12 is now ready to operate. It can be seen in the above illustrations that throughout the installation process, and as held in the operating position, the ground contact is first to be created, and is maintained throughout.

To withdraw the lamp 12, the process is repeated and the lamp is rotated again in any direction about its longitudinal axis L to align the terminals 23, 25, 27 in the insertion slot 30. As a result, the power terminals 23, 27 once again are disconnected from the contacts 22, 26, while the ground connection is maintained between the ground terminal 25 and the ground contact 24. In other words, the ground connection is the last to be broken. Once fully rotated, the lamp 12 can be withdrawn from the lampholder 10.

In the presently illustrated example, both when being inserted and when being withdrawn, the power terminals 23, 27 do not touch any live circuit part when they are pushed into or withdrawn from the insertion slot 30. It will be appreciated, however, that the terminals 23, 27 and/or the contacts 22, 26 may be modified in shape such that the lamp 12 does not need to be rotated and/or may only be required to be rotated an amount other than the ninety degrees illustrated above. In either case, the ground connection is the first connection made during insertion of the lamp 12 into the lampholder 10 to provide a constantly grounded circuit.

Figure 11:
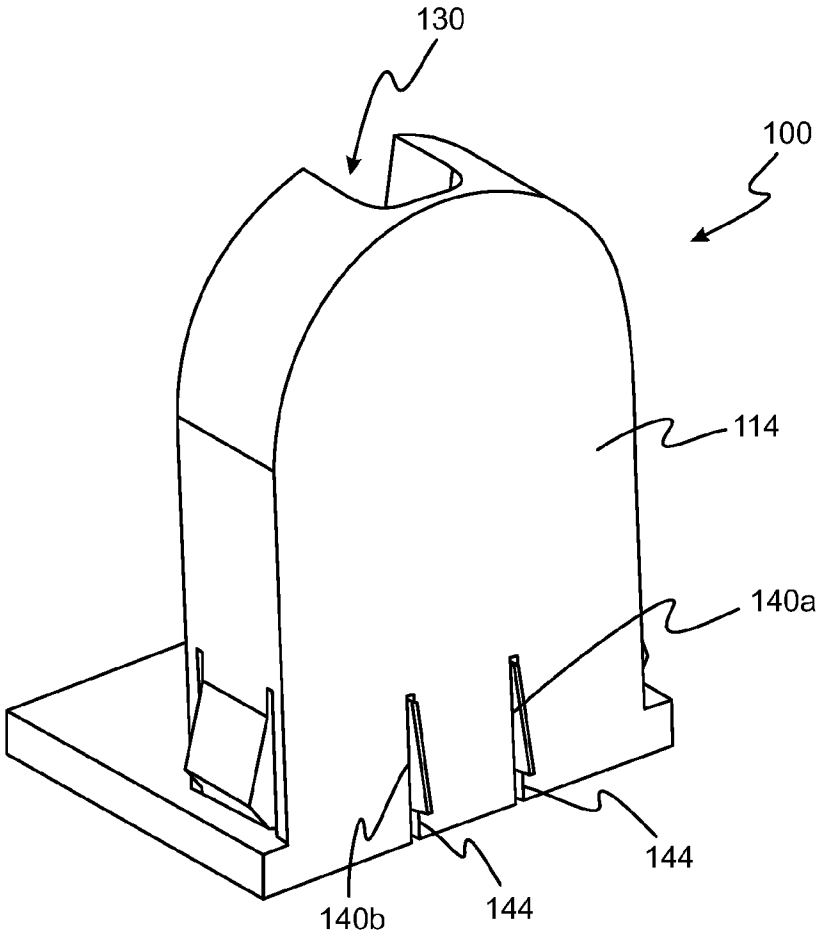
FIG. 11 is a rear perspective view of another example lampholder in accordance with another example of the teachings of the present disclosure.
Figure 12:
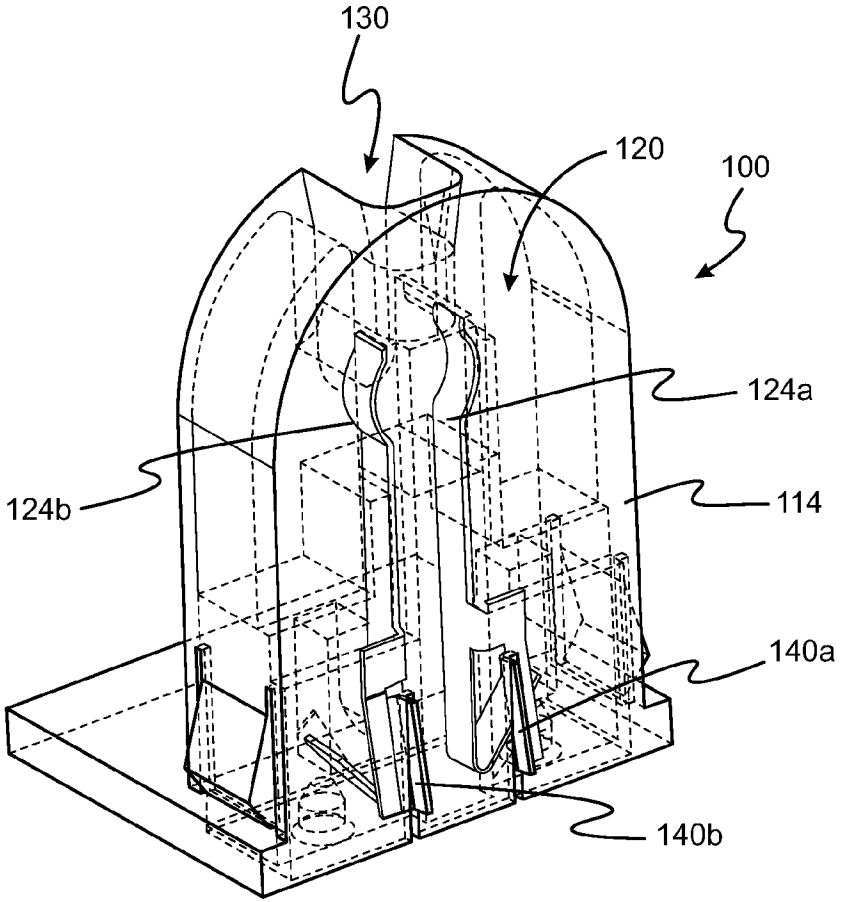
FIG. 12 is a rear perspective view of the lampholder of FIG. 11, showing the interior of the example lampholder housing.
Figure 13:
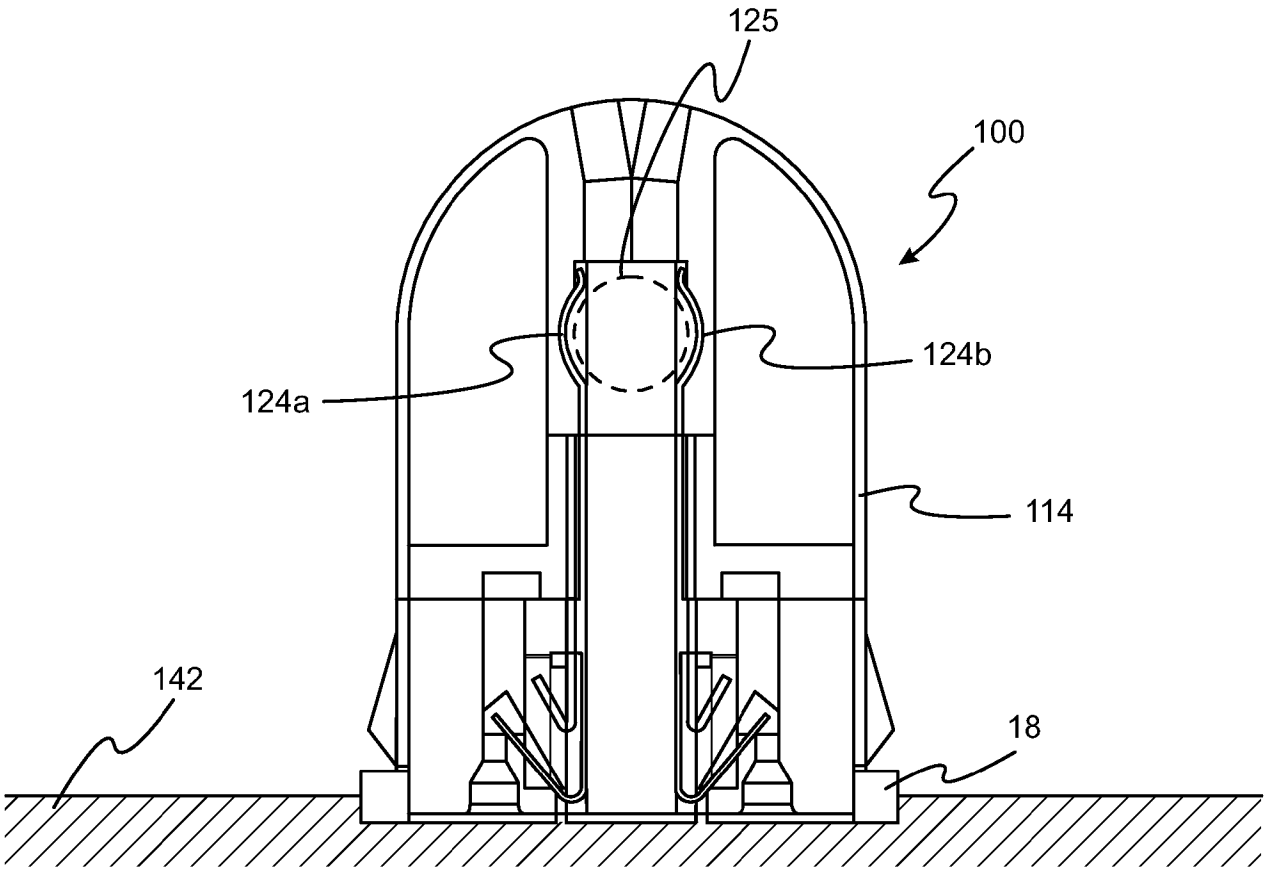
FIG. 13 is a front elevational view of the lampholder of FIG. 12.

A further example of a self-ground lampholder 100 is illustrated in FIGS. 11-13. In this example, the lampholder 100 is adapted to accept an end of a lamp (not shown) in a housing 114 having a single ground terminal. Lamps of the single ground contact type are well known in the art, including, for example, a GX16t-5 lamp. In this example, the housing 11 of the lampholder 100 is similarly constructed to the lampholder 10, but for a modification in the insert slot 130, the interior space 120, and the inclusion of a single contact. In the instance, the lampholder 100 is provided with a single ground contact, which in this example is defined by a first ground contact 124*a* and a second ground contact 124*b*. It will be appreciated by one of ordinary skill in the art that while the single contact comprises a first contact 124*a* and a second contact 124*b*, the contact may be formed from any number of portions, including a single contact portion.

As the example GX16t-6 lamp includes a cylindrical ground post, the first ground contact 124*a* and the second ground contact 124*b* together form a generally arcuate shape 125 corresponding to the outer shape of the ground contact of the lamp. Upon insertion of the lamp into the lampholder 100, the lamp is free to rotate about the ground contact as desired without breaking contact with the ground terminals 124*a*, 124*b*.

In the illustrated example each of the ground contacts 124*a* and 124*b* include a grounding extension 140*a*, 140*b*, respectively, extending from the housing 114 through apertures or slots 144 defined by the housing 114. As with the previous ground contact 24, in this instance, the example contact extensions 140*a*, 140*b* allow the ground contacts 124*a*, 124*b* to be in contact with a base 142 to provide a ground path without requiring additional wiring to the lampholder 100.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

We claim:

1. A lampholder for a lamp having a ground terminal and at least one power terminal, the lampholder comprising:

a housing defining an insertion slot to receive the terminals of the lamp; and a grounding electrical contact and a power providing electrical contract disposed within the housing, wherein the grounding electrical contact is elongated and coaxially aligned within the insertion slot, the power providing electrical contact is electrically isolated from the grounding electrical contact, and the grounding electrical contact is arranged within the housing relative to the power providing electrical contact such that, when the lamp is installed into the lampholder via the insertion slot, at least the ground terminal of the lamp will be electrically coupled to the grounding electrical contact of the lampholder before the at least one power terminal of the lamp is capable of being electrically coupled to the power providing terminal of the lampholder.

2. The lampholder as defined in claim 1, wherein the ground circuit is a luminaire housing.

3. The lampholder as defined in claim 2, wherein the grounding electrical contact directly contacts the luminaire housing.

4. The lampholder as defined in claim 1, wherein the housing defines a slot for receiving the at least one power terminal of the lamp, the slot for receiving the at least one power terminal of the lamp is in communication with the insertion slot, and at least a portion of the power providing electrical contact is disposed within slot for receiving the at least one power terminal of the lamp.

5. The lampholder as defined in claim 4, wherein the slot for receiving the at least one power terminal of the lamp is generally arcuate in shape whereby, after at least the ground terminal of the lamp is electrically coupled to the grounding electrical contact of the lamp holder, the lamp is required to be rotated to electrically couple the at least one power terminal of the lamp to the power providing terminal of the lampholder.

* * * * *